US012004561B2

(12) United States Patent
Pijnenburg et al.

(10) Patent No.: US 12,004,561 B2
(45) Date of Patent: Jun. 11, 2024

(54) SHISHA CARTRIDGE WITH GEL

(71) Applicant: PHILIP MORRIS PRODUCTS S.A., Neuchâtel (CH)

(72) Inventors: Johannes Petrus Maria Pijnenburg, Neuchâtel (CH); Jean-Yves Vollmer, Fontaines-sur-Grandson (CH); Ana Isabel Gonzalez Florez, St-Sulpice (CH); Jakub Bialek, Echandens (CH); Sébastien Capelli, Neuchâtel (CH)

(73) Assignee: PHILIP MORRIS PRODUCTS, S.A., Neuchâtel (CH)

( * ) Notice: Subject to any disclaimer, the term of this patent is extended or adjusted under 35 U.S.C. 154(b) by 705 days.

(21) Appl. No.: 16/973,881

(22) PCT Filed: Jul. 8, 2019

(86) PCT No.: PCT/IB2019/055799

§ 371 (c)(1),
(2) Date: Dec. 10, 2020

(87) PCT Pub. No.: WO2020/012330

PCT Pub. Date: Jan. 16, 2020

(65) Prior Publication Data

US 2021/0259307 A1 Aug. 26, 2021

(30) Foreign Application Priority Data

Jul. 10, 2018 (EP) ..... 18182790

(51) Int. Cl.
*A24F 40/20* (2020.01)
*A24B 15/167* (2020.01)
(Continued)

(52) U.S. Cl.
CPC ..... *A24F 40/42* (2020.01); *A24B 15/167* (2016.11); *A24F 1/30* (2013.01); *A24F 40/20* (2020.01); *A24F 40/485* (2020.01)

(58) Field of Classification Search
CPC ..... A24B 15/167; A24F 1/30; A24F 40/20; A24F 40/42; A24F 40/485
See application file for complete search history.

(56) References Cited

U.S. PATENT DOCUMENTS 5,105,836 A 4/1992 Gentry et al.
5,778,899 A 7/1998 Saito et al.
(Continued)

FOREIGN PATENT DOCUMENTS

EP 2179667 A1 4/2010
EP 2682008 A1 1/2014
(Continued)

OTHER PUBLICATIONS

PCT/IB2019/055799 filed Jul. 8, 2019; International Preliminary Report on Patentability dated Jan. 21, 2021; 12 pages.
(Continued)

*Primary Examiner* — Abdullah A Riyami
*Assistant Examiner* — Thang H Nguyen
(74) *Attorney, Agent, or Firm* — Mueting Raasch Group

(57) ABSTRACT

A shisha cartridge comprises a body defining a cavity and an internal cavity surface. The cartridge comprises an aerosol-forming substrate disposed in the cavity and comprises a layer of gel disposed in the cavity adjacent the internal cavity surface. As the cartridge is heated, the gel may improve aerosol formation.

21 Claims, 5 Drawing Sheets

(51) Int. Cl.

| | |
|---|---|
| ***A24F 1/30*** | (2006.01) |
| ***A24F 40/42*** | (2020.01) |
| ***A24F 40/485*** | (2020.01) |

(56) References Cited

U.S. PATENT DOCUMENTS

| | | | | |
|---|---|---|---|---|
| 9,968,128 | B2 * | 5/2018 | Alfawaz | A24F 1/30 |
| 11,533,947 | B2 * | 12/2022 | Nakash | A24F 1/30 |
| 2010/0083973 | A1 * | 4/2010 | Zoumut | A24F 1/30 131/173 |
| 2016/0157520 | A1 * | 6/2016 | Alfawaz | A24F 1/30 131/226 |
| 2017/0367400 | A1 * | 12/2017 | Hearns | A24B 13/00 |
| 2018/0027883 | A1 * | 2/2018 | Zuber | H05B 6/108 |
| 2018/0199617 | A1 * | 7/2018 | Iodice | A24B 15/167 |
| 2018/0199618 | A1 * | 7/2018 | Fuisz | A24B 15/32 |
| 2019/0124977 | A1 * | 5/2019 | Bonnely | A24F 1/30 |
| 2019/0364960 | A1 * | 12/2019 | Nguyen | A24F 1/30 |
| 2024/0026092 | A1 * | 1/2024 | Maizuru | C08L 101/00 |

FOREIGN PATENT DOCUMENTS

| | | | | |
|---|---|---|---|---|
| RU | 2085091 | C1 | 7/1997 | |
| RU | 2553045 | C2 | 6/2015 | |
| RU | 2645451 | C2 | 2/2018 | |
| SU | 1812956 | A3 | 4/1993 | |
| WO | WO 2014/153515 | A1 | 9/2014 | |
| WO | WO 2016/091804 | A1 | 6/2016 | |
| WO | WO 2017/178930 | A1 | 10/2017 | |
| WO | WO-2019167038 | A1 * | 9/2019 | A24D 1/14 |
| WO | WO 2019/234582 | A1 | 12/2019 | |
| WO | WO-2022175287 | A1 * | 8/2022 | A24F 40/46 |
| WO | WO-2022243897 | A1 * | 11/2022 | A24F 1/30 |

OTHER PUBLICATIONS

Russian Office Action for RU 2020142788, dated Oct. 27, 2022 by the Patent Office of the Russian Federation, 12 pgs. including English translation.

Japanese Office Action for JP 2020-571834, issued by the Japanese Patent Office dated May 1, 2023, 9 pgs. Including English Translation.

International Search Report and Written Opinion for PCT/IB2019/055799, issued by the European Patent Office dated Dec. 3, 2019; 13 pgs.

European Search Report for EP 18182790.8, issued by the European Patent Office dated Jan. 22, 2019; 8 pgs.

* cited by examiner

SHISHA CARTRIDGE WITH GEL

This application is the § 371 U.S. National Stage of International Application No. PCT/IB2019/055799, filed 8 Jul. 2019, which claims the benefit of European Application No. 18182790.8, filed 10 Jul. 2018.

This disclosure relates to shisha devices and to cartridges containing an aerosol-forming substrate for use in shisha devices; and more particularly, to a gel for use in such cartridges that improves aerosol-formation of the aerosol-forming substrate without combusting the substrate.

Traditional shisha devices are used to smoke tobacco and are configured such that vapour and smoke pass through a water basin before inhalation by a consumer. Shisha devices may include one outlet, or more than one outlet so that the device can be used by more than one consumer at a time. Use of shisha devices is considered by many to be a leisure activity and a social experience.

The tobacco used in shisha devices may be mixed with other ingredients to, for example, increase the volume of the vapour and smoke produced, to alter flavour, or both. Charcoal pellets are typically used to heat the tobacco in a traditional shisha device, which may cause full or partial combustion of the tobacco or other ingredients. Additionally, charcoal pellets may generate harmful or potentially harmful products, such as carbon monoxide, which may mix with the shisha vapour and pass through the water basin.

Some shisha devices have been proposed that use electric heat sources to consume the tobacco to, for example, avoid by-products of burning charcoal or to improve the consistency with which the tobacco is heated. Other shisha devices have been proposed that employ e-liquids rather than tobacco. Shisha devices that employ e-liquids eliminate combustion by-products but deprive shisha consumers of the tobacco-based experience.

Other shisha devices have been proposed that employ electric heaters to heat, but not combust, tobacco. Such heat-not-burn shisha devices reduce or eliminate by-products associated with combustion of tobacco but may produce less aerosol than traditional charcoal-based shisha devices and thus may not meet a user's expectation of a traditional shisha experience. The reduced production of aerosol may be more pronounced during initial puffs and may be due to inefficient heat conduction between the heater and the tobacco-based substrate.

Some heat-not-burn shisha devices are used in combination with a substrate that substantially departs from the traditional tobacco-based molasses. For example, the substrate for electronic shishas may include dry stones or e-liquid. These substrates usually have a more homogenous morphology and a higher thermal conductivity than molasses. Molasses tends to be relatively more inhomogeneous and thus difficult to evenly heat. However, users may perceive non-molasses substrates as deteriorating the typical ritual and experience.

Proposed electrically heated shisha devices for use with tobacco-based aerosol-generating substrates, such as molasses, typically employ a capsule or cartridge for housing the aerosol-generating substrate. The cartridge may include an open top and a plurality of holes at the bottom. However, the open top and the plurality of holes, if left unsealed, can lead to loss of freshness (e.g., moisture content) or contamination of the substrate, as well as issues with leakage. In order to maintain freshness and to prevent leakage of the substrate and to preserve the quality and integrity of the substrate during storage, it is desirable to seal the openings and/or holes of the cartridge prior to use. For example, the top and bottom may be closed by a removable cover, lid, or sticker during storage.

The use of stickers or lids to seal the openings involves additional manufacturing steps to form the lids and then attach, for example by welding, adhesive or crimping, the lids to the cartridge. In addition, the stickers are typically disposable, which creates more waste material and, thus, is less economical. Further, the performance of some known covers or stickers are less than optimal. For example, in warmer climates, the adhesives used to form a moisture-tight seal and secure a cover or lid may melt and break the moisture-tight seal, which may lead to loss of freshness, reduction in the quality and integrity of the substrate, and the like.

It would be desirable to provide an aerosol-generating system for electrically heated shisha devices that improves aerosolization. It would also be desirable to provide an aerosol-generating system for electrically heated shisha devices that increases the total aerosol mass (TAM). It would further be desirable to provide an aerosol-generating system for electrically heated shisha devices that reduces the time until a user may take a first puff (time to first puff, also referred to as TT1P). It would further be desirable to provide a capsule or cartridge in which the quality and integrity of the substrate is preserved without the need of a removable cover, lid or sticker. It would further be desirable to provide an aerosol-generating system that allows for the use of traditional substrates (e.g., molasses) while one or more of improving aerosolization, increasing TAM, and decreasing TT1P. It would also be desirable to provide an aerosol-generating system that helps preserve freshness of the substrate during in a more economical way.

Various aspects of the invention relate to a shisha cartridge comprising a body defining a cavity and an internal cavity surface. The cartridge comprises an aerosol-forming substrate disposed in the cavity. The cartridge comprises a gel disposed in the cavity adjacent the internal cavity surface. The gel may also be disposed adjacent the aerosol-forming substrate (e.g., between the internal cavity surface and the aerosol-forming substrate). The gel may be a layer of gel.

The gel and the aerosol-forming substrate are separate distinct components. The aerosol-forming substrate and gel are not combined into a single component. Rather, the aerosol-forming substrate and the gel may be provided in separate layers. Keeping the aerosol-forming substrate and the gel layer as separate components may simplify manufacturing and filling of the cartridges, as an additional composition comprising a mixture of gel and aerosol-forming substrate does not need to be prepared.

The gel and the aerosol-forming substrate may be disposed in the cartridge as separate and distinct layers.

According to an aspect of the present disclosure, a gel or gellified solution is placed inside the capsule to improve aerosolization and the release of sensory active compounds. The gel may include one or more aerosol-formers, sensory active compounds or precursors thereof. An aerosol-former is a compound that, in use, facilitates formation of an aerosol. Such compounds include, although are not limited to, water, glycerine and propylene glycol. A sensory active compound is a compound that allows to trigger a sensory response, e.g. a flavour. The gel may be gelled with a gelling agent selected to lose its gel state as the cartridge containing the gel is heated during the preheating of the electric shisha device.

The gel may be placed at the bottom of the cavity of the cartridge, along the top of the cavity of the cartridge, or along the walls of the cavity of the cartridge. In a preferred embodiment, the gel comes in direct contact with a heated surface when the cartridge is in use.

When the cartridge and the gel inside the cartridge are heated during use, the compounds of the gel partially or entirely vaporize. The vaporized compounds contribute to the formation of the aerosol. The gel may improve aerosolization by increasing the total aerosolized matter generated by the shisha device, particularly during the first few puffs. As such, aerosol production more similar to charcoal-based shisha devices may be obtained with heat-not-burn shisha devices employing the gel in the cartridge with the traditional substrate (molasses), thereby preserving as much as possible of the flavours, aromas, and the rituals associated with traditional shisha devices and substrates. Without the gel, traditional molasses substrates may yield a low amount of total aerosol mass in heat-not-burn shisha devices, particularly during the first few puffs.

The term "aerosol" is used here to refer to a suspension of fine solid particles or liquid droplets in a gas, such as air, which may contain volatile flavour compounds.

In some embodiments, the gel reacts to the increase in temperature during use with an electric shisha device and does not require additional steps by the user to activate or use. Use of the gel in the cartridge may reduce the time to the first puff, increases the total aerosol matter (TAM), or both reduce the time to first puff and increase TAM. TAM is preferentially increased particularly during the first few puffs as it is usually the first few puffs wherein TAM is low with electrically heated shisha devices.

In some embodiments, the gel may be used as a sealing mechanism for one or more ventilation holes in the cartridge. The cartridge may include a peelable or removable liner or cover used to protect the contents during storage. When the cartridge includes a gel layer covering the ventilation holes, the liner or cover can be removed without leakage of the contents while the cartridge is manipulated by the user and placed in the shisha device.

The cartridge may be of any suitable shape configured to be received by a shisha device. The shisha device is configured to heat the gel and the aerosol-forming substrate in the cartridge. The device may be configured to heat the gel and the aerosol-forming substrate in the cartridge by conduction. The cartridge is preferably shaped and sized to allow contact, or minimize distance, between a heating element of shisha device to provide efficient heat transfer from a heater of the shisha to the aerosol-generating substrate in the cartridge. The heat may be generated by any suitable mechanism, such as by resistive heating or by induction. In order to facilitate inductive heating, the cartridge may be provided with a susceptor. For example, the cartridge body may be made from a material (e.g., aluminium) that is capable of acting as a susceptor, or a susceptor material may be provided within the cavity of the cartridge.

The cartridge may have a substantially cuboidal shape, cylindrical shape, frustro-conical shape, or any other suitable shape. Preferably, the cartridge has a generally cylindrical shape or a frustro-conical shape.

The cartridge may comprise any suitable body defining a cavity in which the aerosol-forming substrate is disposed. The body is preferably formed from one or more heat resistant materials, such as a heat resistant polymer or metal. Preferably, the body comprises a thermally conductive material. For example, the body may comprise any of: aluminium, copper, zinc, nickel, silver, any alloys thereof and combinations thereof. Preferably, the body comprises aluminium.

The body may comprise a top, bottom and sidewall. The body may comprise one or more part. For example, the sidewall and the bottom may be a single part or two parts configured to engage one another in any suitable manner, such as threaded engagement or interference fit. The top and sidewall may be a single part or two parts configured to engage one another in any suitable manner, such as threaded engagement or interference fit.

The body defines a cavity in which the aerosol-forming substrate and the gel may be disposed. A portion of the body defining the cavity may have a heatable wall or surface. As used herein, "heatable wall" and "heatable surface" mean an area of a wall or a surface to which heat applied, either directly or indirectly. For example, the heatable wall or surface of the portion of the body defining the cavity is a surface through which heat may be transferred from outside of the cavity through the body to the wall or surface of the body defining the cavity.

The aerosol-forming substrate may occupy any suitable volume of the cavity. The volume of the aerosol-forming substrate in the cartridge may be varied by altering the amount, composition, shape, packing density or format of the aerosol-forming substrate placed in the cartridge.

Any suitable aerosol-forming substrate may be provided in the cavity defined by the body of the cartridge. Preferably, the aerosol-forming substrate is a shisha substrate. The aerosol-forming substrate is preferably a substrate capable of releasing volatile compounds that may form an aerosol. The volatile compounds may be released by heating the aerosol-forming substrate.

The aerosol-forming substrate may be solid or liquid or comprise both solid and liquid components. Preferably, the aerosol-forming substrate comprises a solid.

The aerosol-forming substrate may comprise nicotine. The nicotine containing aerosol-forming substrate may comprise a nicotine salt matrix. The aerosol-forming substrate may comprise plant-based material. The aerosol-forming substrate preferably comprises tobacco, and preferably the tobacco containing material contains volatile tobacco flavour compounds, which are released from the aerosol-forming substrate upon heating. The aerosol-forming substrate may comprise homogenized tobacco material. Homogenized tobacco material may be formed by agglomerating particulate tobacco. The aerosol-forming substrate may alternatively or additionally comprise a non-tobacco-containing material. The aerosol-generating substrate may comprise homogenized plant-based material.

The aerosol-forming substrate may comprise, for example, one or more of: powder, granules, pellets, shreds, spaghettis, strips or sheets containing one or more of: herb leaf, tobacco leaf, fragments of tobacco ribs, reconstituted tobacco, homogenized tobacco, extruded tobacco and expanded tobacco.

The aerosol-forming substrate may comprise at least one aerosol-former. The aerosol-former may be any suitable known compound or mixture of compounds that, in use, facilitates formation of a dense and stable aerosol and that is substantially resistant to thermal degradation at the operating temperature of the shisha device. Suitable aerosol-formers are well known in the art and include, but are not limited to: polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Particularly preferred aerosol formers are polyhydric alcohols or mixtures thereof, such as triethylene glycol, 1,3-butanediol and, most preferred, glycerine. The aerosol-forming substrate may comprise other additives and ingredients, such as flavourants. The aerosol-forming substrate preferably comprises nicotine and at least one aerosol-former. In some embodiments, the aerosol-former is glycerine or a mixture of glycerine and one or more other suitable aerosol-formers, such as those listed above.

The aerosol-forming substrate may comprise any suitable amount of an aerosol-former. For example, the aerosol-former content may be equal to or greater than 5% on a dry weight basis, and preferably between greater than 30% by weight on a dry weight basis. The aerosol-former content may be less than about 95% on a dry weight basis. Preferably, the aerosol-former content is up to about 55%.

The aerosol-forming substrate may be provided on or embedded in a thermally stable carrier. The term "thermally stable" is used here to indicate a material that does not substantially degrade at temperatures to which the substrate is typically heated (e.g., about 150° C. to about 300° C.). The carrier may comprise a thin layer on which the substrate deposited on a first major surface, on second major outer surface, or on both the first and second major surfaces. The carrier may be formed of, for example, a paper, or paper like material, a non-woven carbon fiber mat, a low mass open mesh metallic screen, or a perforated metallic foil or any other thermally stable polymer matrix. Alternatively, the carrier may take the form of powder, granules, pellets, shreds, spaghettis, strips or sheets. The carrier may be a non-woven fabric or fiber bundle into which tobacco components have been incorporated. The non-woven fabric or fiber bundle may comprise, for example, carbon fibers, natural cellulose fibers, or cellulose derivative fibers. In embodiments, where the gel acts as a barrier, the carrier may be omitted.

In some examples, the aerosol-forming substrate comprises one or more sugars in any suitable amount. Preferably, the aerosol-forming substrate comprises invert sugar, which is a mixture of glucose and fructose obtained by splitting sucrose. Preferably, the aerosol-forming substrate comprises from about 1% to about 40% sugar, such as invert sugar, by weight. In some example, one or more sugars may be mixed with a suitable carrier such as cornstarch or maltodextrin.

The aerosol-forming substrate may comprise tobacco and molasses.

In some examples, the aerosol-forming substrate comprises one or more sensory-enhancing agents. Suitable sensory-enhancing agents include flavourants and sensation agents, such as cooling agents. Suitable flavourants include natural or synthetic menthol, peppermint, spearmint, coffee, tea, spices (such as cinnamon, clove and/or ginger), cocoa, vanilla, fruit flavours, chocolate, eucalyptus, geranium, eugenol, agave, juniper, anethole, linalool, and any combination thereof.

In some examples, the aerosol-forming substrate is in the form of a suspension. For example, the aerosol generating substrate may comprise molasses. As used herein, "molasses" means an aerosol-forming substrate composition comprising about 20% or more sugar. For example, the molasses may comprise at least about 25% by weight sugar, such as at least about 35% by weight sugar. Typically, the molasses will contain less than about 60% by weight sugar, such as less than about 50% by weight sugar.

Aerosol-forming substrates for use with traditional shisha devices are in the form of a molasses, which may be nonhomogeneous and may contain lumps and cavities. Such cavities prevent direct thermal contact between the substrate and a heated surface making thermal conduction particularly inefficient. As a consequence, electronic heated shisha devices tend to depart from traditional molasses by using, for example, e-liquids or dry stones. Due to the use of a gel in the cartridge described in the present application, more traditional aerosol-forming substrate molasses may be used to preserve the typical ritual and shisha experience while using electric heating.

Any suitable amount of aerosol-forming substrate (e.g., molasses or tobacco substrate) may be disposed in the cavity. In some preferred embodiments, about 3 g to about 25 g of the aerosol-forming substrate is disposed in the cavity. The cartridge may include at least 6 g, at least 7 g, at least 8 g, or at least 9 g of aerosol-forming substrate. The cartridge may include up to 15 g, up to 12 g; up to 11 g, or up to 10 g of aerosol-forming substrate. Preferably, from about 7 g to about 13 g of aerosol-forming substrate is disposed in the cavity. More preferably, about 10 g of aerosol-forming substrate is disposed in the cavity.

Preferably, the body of the cartridge has a length of about 15 cm or less, has an inner diameter of about 1 cm or more, and has a heatable surface area in the cavity from about 30 $cm^2$ to about 100 $cm^2$, such as from about 70 $cm^2$ to about 100 $cm^2$, and the volume of the cavity is from about 10 $cm^3$ to about 50 $cm^3$; preferably from about 25 $cm^3$ to about 40 $cm^3$. More preferably, the body has a length of about 10 cm or less, an inner diameter of about 1.75 cm or more, and has a heatable surface area in the cavity from about 30 $cm^2$ to about 100 $cm^2$, such as from about 70 $cm^2$ to about 100 $cm^2$, and the volume of the cavity is from about 10 $cm^3$ to about 50 $cm^3$; preferably from about 25 $cm^3$ to about 40 $cm^3$. Even more preferably, the body has a length in a range from about 3.5 cm to about 7 cm, has an inner diameter in a range from about 1.5 cm to about 4 cm, and has a heatable surface area in the cavity from about 30 $cm^2$ to about 100 $cm^2$, such as from about 70 $cm^2$ to about 100 $cm^2$, and the volume of the cavity is from about 10 $cm^3$ to about 50 $cm^3$; preferably from about 25 $cm^3$ to about 40 $cm^3$. Preferably, the body is cylindrical or frustroconical.

Preferably, the cartridge comprises an amount of aerosol-forming substrate that will provide a sufficient amount of aerosol for a shisha experience lasting from about 10 minutes to about 60 minutes; preferably from about 20 minutes to about 50 minutes; and more preferably from about 30 minutes to about 40 minutes.

In some embodiments, the cartridge comprises one or more ventilation holes. The ventilation holes may be inlets or outlets, and may be disposed at the bottom, top, and/or sides of the cartridge. In some embodiments, the cartridge comprises one or more inlets and one or more outlets to allow air to flow through the aerosol-forming substrate when the cartridge is used with a shisha device. In some embodiments, the top of the cartridge may define one or more apertures to form the one or more inlets of the cartridge. In some embodiments, the bottom the cartridge may define one or more apertures to form the one or more outlets of the cartridge. Preferably, the one or more inlets and outlets are sized and shaped to provide a suitable resistance to draw (RTD) through the cartridge. In some examples, the RTD through the cartridge, from the inlet or inlets to the outlet or outlets, may be from about 10 mm $H_2O$ to about 50 mm $H_2O$, preferably from about 20 mm $H_2O$ to about 40 mm $H_2O$. The RTD of a specimen refers to the static pressure difference between the two ends of the specimen when it is traversed by an air flow under steady conditions in which the volumetric flow is 17.5 millilitres per second at the output end. The RTD of a specimen can be measured using the method set out in ISO Standard 6565:2002 with any ventilation blocked.

According to an aspect of the present disclosure, the cartridge includes a gel or gellified solution disposed inside the cartridge. The gel may include a gelling agent. The gelling agent may be selected to retain its morphology (e.g., shape or gel state) up to a minimum temperature. By retaining its morphology it is meant that the gel does not leak out of the cartridge through the ventilation holes and, if used as a seal, the gel is still able to function as a seal for the holes. For example, the gelling agent may retain its morphology up to a temperature of at least 40° C., at least 45° C., at least 50° C., at least 60° C., or at least 70° C. The gelling agent may retain its morphology at a temperature of up to 150° C., up to 120° C., up to 100° C., up to 80° C., or up to 70° C. The temperature at which the gelling agent loses its morphology may be adjusted, for example, by modifying the composition of the gel, such as by altering the concentration of the gelling agent or by choosing a different gelling agent or mixture of gelling agents. For example, low acyl gellan provides increased heat resistance compared to agar. The gelling agent may lose its gel state. As used herein, the phrase "loses its gel state" refers to the gel undergoing a morphological change. The morphological change may be a change in state from a solid to a liquid or a gas. The morphological change may be a change in viscosity, such as a reduction in viscosity. The reduction in viscosity may be a reduction of at least 20% of the initial viscosity of the gel at room temperature prior heating, may be a reduction of at least 40% of the initial viscosity of the gel at room temperature prior heating, may be a reduction of at least 60% of the initial viscosity of the gel at room temperature prior heating, or more preferably may be a reduction of at least 85% of the initial viscosity of the gel at room temperature prior heating. The morphological change may be the gel losing its cross-linked nature. Losing its cross-linked nature may mean a loss of at least 18% of the cross linkage, a loss of at least 20% of the cross linkage, a loss of at least 40% of the cross linkage, a loss of at least 50% of the cross linkage, or more preferably, a loss of at least 80% of the cross linkage. The morphological change may include one or more of a change in state from a solid to a liquid or a gas, a change in viscosity, and a loss in cross-linked nature.

The gel may be arranged to lose its gel state during the pre-heat time of the electric shisha. For example, the gelling agent may lose its gel state in about 4 minutes at 200° C., or in no more than 1 minute, no more than 2 minutes, no more than 3 minutes, no more than 4 minutes, no more than 5 minutes, no more than 6 minutes, or no more than 8 minutes. There is no desired lower limit for how fast the gelling agent loses its gel state during the pre-heat phase, as long as the gelling agent remains a gel at room temperature and during storage (e.g., at temperatures ranging from at least 10° C. to 50° C.). The gelling agent may lose its gel state when the shisha (e.g., the cartridge) is heated to a temperature of 150° C. or greater, at 180° C. or greater, or at 190° C. or greater. The gelling agent may lose its gel state at a temperature of up to 200° C., up to 210° C., up to 220° C., or up to 250° C.

According to an embodiment, the gel includes one or more aerosol-former compound that may aid in forming aerosols as the gel is heated. Suitable aerosol-formers are well known in the art and include, but are not limited to: polyhydric alcohols, such as triethylene glycol, propylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Particularly preferred aerosol formers are polyhydric alcohols or mixtures thereof, such as triethylene glycol, propylene glycol, 1,3-butanediol and, most preferred, glycerine. The gel may comprises any suitable amount of the one or more aerosol-former compounds. For example, the gel may include 10 wt-% or greater, 20 wt-10% or greater, 30 wt-% or greater, 35 wt-% or greater, 40 wt-% or greater, or 45 wt-% or greater of one or more aerosol-former. The gel may include up to 80 wt-%, up to 75 wt-%, up to 70 wt-%, up to 65 wt-%, up to 60 wt-%, up to 55 wt-%, or up to 50 wt-% of one or more aerosol-former. In one embodiment, the gel includes between 40 to 70 wt-% of one or more aerosol-former. In one embodiment, the gel does not include volatile compounds.

Any suitable, non-toxic gelling agent may be used. For example, the gelling agent may include agar, carrageenan, xanthan gum, gellan gums (low acyl gellan gum, high acyl gellan gums), alginates (alginic acid), guar gum, gelatine, pectin, or a combination thereof. The content of the gelling agent may be adjusted based on the gelling agent and the desired time it takes for the gel to lose its gel state. The gel may include at least 0.2 wt-%, at least 0.4 wt-%, at least 0.5 wt-%, at least 0.7 wt-%, at least 1 wt-%, or at least 1.5 wt-% of gelling agent. The gel may include up to 10 wt-%, up to 8 wt-%, up to 6 wt-%, up to 5 wt-%, up to 4 wt-%, or up to 3 wt-% of gelling agent. In one embodiment, the gel includes from 0.5 wt-% to 3 wt-% of gelling agent.

When the gel is at its gel state (e.g., prior to heating to a temperature where the gel loses its gel state), the gel may act as a seal at the bottom (or top) of the cartridge.

When the gel is heated to the temperatures discussed above and loses its gel state, a substantial part of the compounds of the gel (e.g., the volatile compounds) are transferred to the gas phase. Evaporation of the compounds of the gel ensures that the ventilation holes of the cartridge are open for airflow when the shisha is used. For example, at least 40%, at least 50%, at least 60%, at least 70%, at least 80%, at least 90%, or at least 95% of the volatile compounds are transferred to the gas phase. Up to 100%, up to 99%, up to 98%, up to 95%, or up to 90% of the volatile compounds are transferred to the gas phase upon heating.

The gel may include water or other suitable solvents or may be free of solvents. The gel may include 0 wt-% or more, at least 1 wt-%, at least 5 wt-%, at least 10 wt-%, at least 20 wt-%, or at least 30 wt-% of water or other solvent. The gel may include up to 75 wt-%, up to 60 wt-%, up to 50 wt-%, up to 40 wt-%, up to 30 wt-%, up to 20 wt-%, or up to 10 wt-% of water or other solvent. In one embodiment, the gel includes from 10 wt-% to 60 wt-% of water or other solvent.

The gel may further include nicotine. The nicotine may be added to the gel in a free base form or a salt form. The gel may include about 1 to about 3 wt-% nicotine, or about 1.5 to about 2.5 wt-%, or about 2 wt-% nicotine. In embodiments where the gel includes nicotine, the nicotine component may be the most volatile component of the gel.

The gel may be placed in direct contact with a heated surface of the cartridge. For example, the gel may be in direct contact with an inside surface of the capsule, such as the bottom, side wall, top, or a combination thereof. A layer of gel layer may line at least a part of the cavity of the cartridge. Placement of the gel around the periphery of the substrate in the cartridge (e.g., surrounding the substrate on one or more sides) allows the aerosol effect to be targeted towards first few puffs. The gel may produce aerosol-forming vapour upon heating and/or increase the number of condensation nuclei available at the beginning of the smoking experience, causing aerosol generation to start faster, and for more aerosol to be generated, particularly during first few puffs. For example, the gel may increase the amount of aerosol to be generated during the first 5, first 10, first 15, first 20, or first 30 puffs.

The use of the gel may also reduce the time it takes for the shisha device to be ready for the first puff (i.e., the time to first puff, or TT1P). Typically, the TT1P is approximately 4 minutes. However, by using a gel to increase the amount of aerosols available during the first few puffs, the TT1P may be reduced by about 0.1 minutes to about 1.5 minutes. In some embodiments, the TT1P is about 2.5 minutes to about 4 minutes.

The amount of gel in the cartridge and the arrangement of the gel (e.g., the thickness and placement of the gel layer) can be selected to achieve the desired effect (e.g., a desired increase in aerosol, desired number of initial puffs affected, desired TT1P, etc.). The cartridge may include at least 0.4 g, at least 0.5 g, or at least 0.6 g of gel. The cartridge may include up to 1.3 g, up to 1.2 g, up to 1.1 g, up to 1.0 g, up to 0.9 g, or up to 0.8 g of gel. In some embodiments, the cartridge includes about 0.7 g of gel. The gel may have a thickness of at least 0.1 mm, at least 0.2 mm, at least 0.3 mm, at least 0.5 mm, or at least 1 mm. The gel may have a thickness of up to 5 mm, up to 4 mm, up to 3 mm, up to 2 mm, or up to 1 mm. In one embodiment, the gel has a thickness of 0.1 mm to 3 mm. The thickness of the gel may cover the entire surface of the bottom, top, and/or sidewalls of the cartridge. The gel may have a surface area (top and bottom surfaces combined) of at least 1 $cm^2$, at least 1.5 $cm^2$, at least 2 $cm^2$, at least 4 $cm^2$, or at least 6 $cm^2$. The gel may have a surface area of up to 25 $cm^2$, up to 20 $cm^2$, up to 15 $cm^2$, or up to 10 $cm^2$. In one embodiment, the gel has a surface area of 2 $cm^2$ to 20 $cm^2$.

The aerosol-forming substrate may have a first time to first puff and the gel may have a second time to first puff. Preferably the second time to first puff is shorter than the first time to first puff.

According to one embodiment, the cartridge comprises a body defining a cavity and an internal surface, and the cartridge contains the substrate and the gel within the cavity, where the gel is disposed at the bottom, top, and/or along sidewalls of the cartridge. The gel may be disposed below the substrate and/or surrounding the substrate. Prior to heating, the gel may cover at least some of the ventilation holes of the cartridge.

The gel (e.g., a layer of gel) may be disposed between an internal cavity surface and the aerosol-forming substrate.

The cartridge may include a first removable seal covering the one or more inlets and a second removable seal covering the one or more outlets. The first and second seals are preferably sufficient to prevent air flow through the inlets and outlets to prevent leakage of the contents of the cartridge and to extend shelf life. The seal may comprise a peelable label of sticker, foil, or the like. The label, sticker, or foil may be affixed to the cartridge in any suitable manner, such as with an adhesive, crimping, welding, or otherwise being joined to the container. The seal may comprise a tab that may be grasped to peel or remove the label, sticker, or foil from the cartridge.

A shisha cartridge according to the present invention may be used with any suitable shisha device. Preferably, the shisha device is configured to sufficiently heat the aerosol-generating substrate in the cartridge to cause formation of aerosol from the aerosol-forming substrate but not to combust the aerosol-forming substrate. For example, the shisha device may be configured to heat the aerosol-forming substrate to a temperature in a range from about 150° C. to about 300° C.; more preferably from about 180° C. to about 250° C. or from about 200° C. to about 230° C.

The shisha device may comprise a receptacle for receiving the cartridge. The shisha device comprises a heating element configured to contact or to be in proximity to the body of the cartridge when the cartridge is received in the receptacle. The heating element may form at least part of the receptacle. The heating element may form at least a portion of the surface of the receptacle. The shisha cartridge may be configured to transfer heat from the heating element to the aerosol-forming substrate in the cavity by conduction. In some embodiments, the heating element comprises an electric heating element. In some embodiments, the heating element comprises a resistive heating component. For example, the heating element may comprise one or more resistive wires or other resistive elements. The resistive wires may be in contact with a thermally conductive material to distribute heat produced over a broader area. Examples of suitable conductive materials include aluminium, copper, zinc, nickel, silver, and combinations thereof. For purposes of this disclosure, if resistive wires are in contact with a thermally conductive material, both the resistive wires and the thermally conductive material are part of the heating element. The heating element may form at least a portion of the surface of the receptacle.

The shisha device may comprise control electronics operably coupled to the heating element to control heating of the heating element and thus control the temperature at which the aerosol-forming substrate in the cartridge is heated. The control electronics may be provided in any suitable form and may, for example, include a controller or a memory and a controller. The controller may include one or more of an Application Specific Integrated Circuit (ASIC) state machine, a digital signal processor, a gate array, a microprocessor, or equivalent discrete or integrated logic circuitry. Control electronics may include memory that contains instructions that cause one or more components of the circuitry to carry out a function or aspect of the control electronics. Functions attributable to control electronics in this disclosure may be embodied as one or more of software, firmware, and hardware.

The electronic circuitry may comprise a microprocessor, which may be a programmable microprocessor. The electronic circuitry may be configured to regulate a supply of power. The power may be supplied to the heater element in the form of pulses of electrical current.

In some examples, the control electronics may be configured to monitor the electrical resistance of the heating element and to control the supply of power to the heating element depending on the electrical resistance of the heating element. In this manner, the control electronics may regulate the temperature of the resistive element.

The shisha device may comprise a temperature sensor, such as a thermocouple, operably coupled to the control electronics to control the temperature of the heating element. The temperature sensor may be positioned in any suitable location. For example, the temperature sensor may be configured to insert into the cartridge when received within the receptacle to monitor the temperature of the aerosol-forming substrate being heated. In addition or alternatively, the temperature sensor may be in contact with the heating element. In addition or alternatively, the temperature sensor may be positioned to detect temperature at an aerosol outlet of the shisha device or a portion thereof. The sensor may transmit signals regarding the sensed temperature to the control electronics, which may adjust heating of the heating elements to achieve a suitable temperature at the sensor.

The shisha device or the cartridge may include an indicator for when the capsule is ready for use. For example, the shisha device or the cartridge may include an indicator that indicates to the user when the cartridge and the gel inside the cartridge has heated to a sufficient temperature (and/or for a sufficient amount of time) so that the shisha is ready for use.

The control electronics may be operably coupled to a power supply. The shisha device may comprise any suitable power supply. For example, a power supply of a shisha device may be a battery or set of batteries. The batteries of the power supply may be rechargeable, removable and replaceable, or rechargeable and removable and replaceable. Any suitable battery may be used. For example, heavy duty type or standard batteries existing in the market, such as used for industrial heavy duty electrical power-tools. Alternatively, the power supply may be any type of electric power supply including a super or hyper-capacitor. Alternatively, the assembly can be connected to an external electrical power source, and electrically and electronically designed for such purpose. Regardless of the type of power supply employed, the power supply preferably provides sufficient energy for the normal functioning of the assembly for at least one shisha session until aerosol is depleted from the aerosol-forming substrate in the cartridge before being recharged or needing to connect to an external electrical power source. Preferably, the power supply provides sufficient energy for the normal functioning of the assembly for at least about 70 minutes of continuous operation of the device, before being recharged or needing to connect to an external electrical power source.

In one example, a shisha device includes an aerosol-generating element that comprises a cartridge receptacle, a heating element, an aerosol outlet, and a fresh air inlet. The cartridge receptacle is configured to receive a cartridge containing the aerosol-forming substrate and the gel. The cartridge may be as above described. The heating element may define at least part of a surface of the receptacle.

The shisha device comprises a fresh air inlet channel in fluid connection with the receptacle. Initially, the gel may block the ventilation holes of the cartridge (e.g., the inlet holes and/or the outlet holes). In use, when the gel is heated, the gel or components in the gel melt and/or vaporize, opening a passage in the gel for the air and aerosol flow, allowing fresh air to flow through the fresh air inlet channel to the receptacle and through the cartridge disposed in the receptacle. Fresh air flowing through the cartridge becomes entrained with aerosol generated from the aerosol-forming substrate in the cartridge. The fresh air entrained with aerosol flows to the gel and/or the aerosol.

The fresh air inlet channel may comprise one or more apertures through the cartridge receptacle such that fresh air from outside the shisha device may flow through the channel and into the cartridge receptacle through the one or more apertures. If a channel comprises more than one aperture, the channel may comprise a manifold to direct air flowing through the channel to each aperture. Preferably, the shisha device comprises two or more fresh air inlet channels.

As described above, the cartridge comprises one or more inlets formed in the housing to allow air flow through the chambers of the cartridge when in use. If the receptacle comprises one or more inlet apertures, at least some of the inlets in the cartridge may align with the apertures in the top of the receptacle. The cartridge may comprise an alignment feature configured to mate with a complementary alignment feature of the receptacle to align the inlets of the cartridge with the apertures of the receptacle when the cartridge is inserted into the receptacle.

Air that enters the cartridge flows across the aerosol-forming substrate, entrains aerosol, and exits the cartridge and receptacle via an aerosol outlet. From the aerosol outlet, the air carrying the aerosol enters a vessel of the shisha device.

The shisha device may comprise any suitable vessel defining an interior volume configured to contain a liquid and defining an outlet in the head-space above a liquid fill level. The vessel may comprise an optically transparent or opaque housing to allow a consumer to observe contents contained in the vessel. The vessel may comprise a liquid fill demarcation, such as a liquid fill line. The vessel housing may be formed of any suitable material. For example, the vessel housing may comprise glass or suitable rigid plastic material. Preferably, the vessel is removable from a portion of the shisha assembly comprising the aerosol-generation element to allow a consumer to fill, empty or clean the vessel.

The vessel may be filled to a liquid fill level by a consumer. The liquid preferably comprises water, which may optionally be infused with one or more colorants, flavourants, or colorants and flavourants. For example, the water may be infused with one or both of botanical or herbal infusions.

Aerosol entrained in air exiting the aerosol outlet of the receptacle may travel through a conduit positioned in the vessel. The conduit may be coupled to the aerosol outlet of the aerosol generating element of the shisha assembly and may have an opening below the liquid fill level of the vessel, such that aerosol flowing through the vessel flows through the opening of the conduit, then through the liquid, into headspace of the vessel and exits through a headspace outlet, for delivery to a consumer.

The headspace outlet may be coupled to a hose comprising a mouthpiece for delivering the aerosol to a consumer. The mouthpiece may comprise a switch activatable by a user or a puff sensor operably coupled to the control electronics of the shisha device. Preferably, the switch or puff sensor is wirelessly coupled to the control electronics. Activation of a switch or puff sensor may cause the control electronics to activate the heating element, rather than constantly supplying energy to the heating element. Accordingly, the use of a switch or puff sensor may serve to save energy relative to devices not employing such elements to provide on-demand heating rather than constant heating.

For purposes of example, one method for using a shisha device as described herein is provided below in chronological order. The vessel may be detached from other components of the shisha device and filled with water. One or more of natural fruit juices, botanicals, and herbal infusions may be added to the water for flavouring. The amount of liquid added should cover a portion of the conduit but should not exceed a fill level mark that may optionally exist on the vessel. The vessel is then reassembled to the shisha device. A portion of the aerosol generating element may be removed or opened to allow the cartridge to be inserted into the receptacle. The aerosol generating element is then reassembled or closed. The device may then be turned on. Turning on the device may initiate a heating profile of a heating element, to heat the gel and the aerosol-forming substrate to a temperature at or above a vaporisation temperature of the gel (or components of the gel) and the aerosol-forming substrate, but below a combustion temperature of the aerosol-forming substrate. The gel or components in the gel melt and/or vaporize, opening a passage in the gel for the air and aerosol flow. The user may puff on the mouth piece as desired. The user may continue using the device until no more aerosol is visible or being delivered. In some embodiments, the device will automatically shut off when the cartridge is depleted of usable aerosol-generating substrate. In some embodiments, the consumer may refill the device with a fresh cartridge after, for example, receiving the cue from the device that the aerosol-forming substrate in the cartridge is depleted or nearly depleted. If refilled with a fresh cartridge, the device may continue to be used. Preferably, the shisha device may be turned off at any time by a consumer by, for example, switching off the device.

The shisha device may have any suitable air management. In one example, puffing action from the user will create a suction effect causing a low pressure inside the device which will cause external air to flow through air inlet of the device, into the fresh air inlet channel, and into the receptacle. The air may then flow through the cartridge in the receptacle to carry aerosol produced from the aerosol-forming substrate. The air with entrained aerosol then exits the aerosol outlet of the receptacle, flows through the conduit to the liquid inside the vessel. The aerosol will then bubble out of the liquid and into head space in the vessel above the level of the liquid, out the headspace outlet, and through the hose and mouthpiece for delivery to the consumer. The flow of external air and the flow of the aerosol inside the shisha device may be driven by the action of puffing from the user.

Reference will now be made to the drawings, which depict one or more aspects described in this disclosure. However, it will be understood that other aspects not depicted in the drawings fall within the scope and spirit of this disclosure. Like numbers used in the figures refer to like components. However, it will be understood that the use of a number to refer to a component in a given figure is not intended to limit the component in another figure labeled with the same number. In addition, the use of different numbers to refer to components in different figures is not intended to indicate that the different numbered components cannot be the same or similar to other numbered components. The figures are presented for purposes of illustration and not limitation. Schematic drawings presented in the figures are not necessarily to scale.

Figure 1:
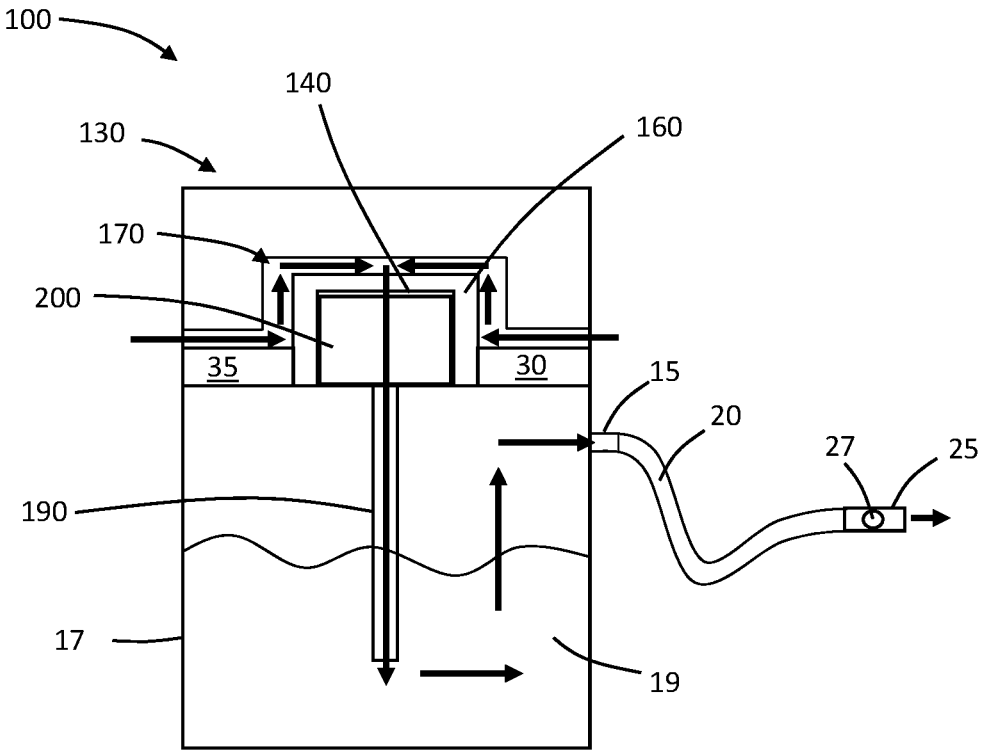
FIG. 1 is a schematic sectional view of a shisha device.

FIG. 1 is a schematic sectional view of an example of a shisha device 100. The device 100 includes a vessel 17 defining an interior volume configured to contain liquid 19 and defining a headspace outlet 15 above a fill level for the liquid 19. The liquid 19 preferably comprises water, which may optionally be infused with one or more colorants, one or more flavourants, or one or more colorants and one or more flavourants. For example, the water may be infused with one or both of botanical infusions or herbal infusions.

The device 100 also includes an aerosol-generating element 130. The aerosol-generating element 130 includes a receptacle 140 configured to receive a cartridge 200 containing an aerosol-generating substrate and, at least initially, a gel. The aerosol-generating element 130 also includes a heating element 160 that forms at least one surface of the receptacle 140. In the depicted embodiment, the heating element 160 defines the top and side surfaces of the receptacle 140. The aerosol-generating element 130 also includes a fresh air inlet channel 170 that draws fresh air into the device 100. A portion of the fresh air inlet channel 170 is formed by the heating element 160 to heat the air before the air enters the receptacle 140. The pre-heated air then enters the cartridge 200 (or substrate that is not a cartridge), which is also heated by heating element 160, to carry aerosol generated by aerosol generating substrate. The air exits an outlet of the aerosol-generating element 130 and enters a conduit 190.

The conduit 190 carries the air and aerosol into the vessel 17 below the level of the liquid 19. The air and aerosol may bubble through the liquid 19 and exit the headspace outlet 15 of the vessel 17. A hose 20 may be attached to the headspace outlet 15 to carry the aerosol to the mouth of a user. A mouthpiece 25 may be attached to, or form a part of, the hose 20.

An exemplary air flow path of the device, in use, is depicted by thick arrows in FIG. 1.

The mouthpiece 25 may include an activation element 27. The activation element 27 may be a switch, button or the like, or may be a puff sensor or the like. The activation element 27 may be placed at any other suitable location of the device 100. The activation element 27 may be in wireless communication with the control electronics 30 to place the device 100 in condition for use or to cause control electronics to activate the heating element 160; for example, by causing power supply 35 to energize the heating element 140.

The control electronics 30 and power supply 35 may be located in any suitable position of the aerosol generating element 130 other than the bottom portion of the element 130 as depicted in FIG. 1.

Figure 2A:
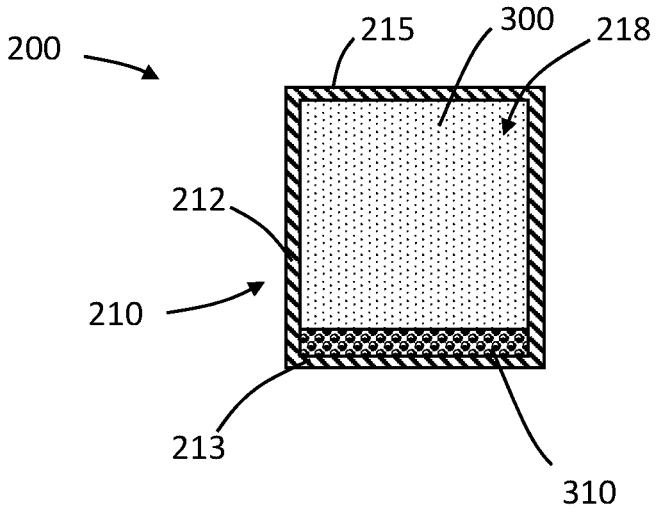
FIGS. 2A and 2B are schematic sectional views of a cartridge with aerosol-forming substrate and gel.
Figure 2B:
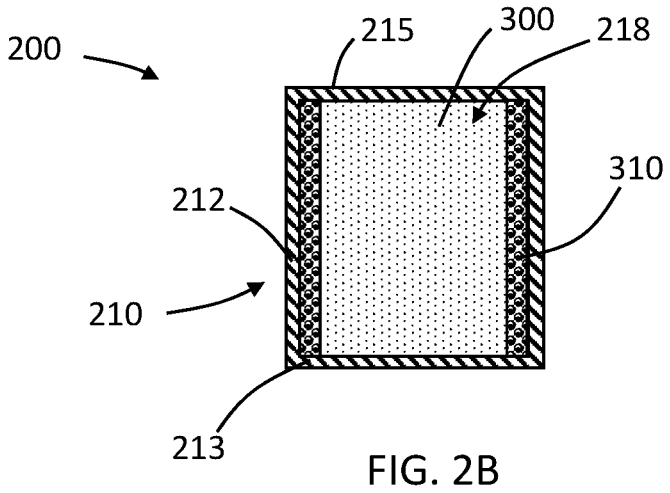

Referring to FIGS. 2A and 2B, a cartridge 200 has body 210 defining a cavity 218 in which an aerosol-forming substrate 300 and a gel 310 may be disposed. The body 210 includes a top 215, bottom 213, and a sidewall 212. The body 210 may be formed from one or more parts. For example, the top 215 or bottom 213 may be removably attached from the sidewall 212 to allow the aerosol-forming substrate 300 and gel 310 to be disposed in the cavity 218. The gel 310 may be disposed along the bottom 213 of the cavity 218, as shown in FIG. 2, or along the side wall 212, as shown in FIG. 3. The gel 310 may also be disposed along the top 215, or along any combination of the bottom 213, the top 215, or the side wall 212, and/or may cover any of these surfaces in part.

The cartridge 200 has a heatable surface area inside the cavity 218, which is a surface capable of transferring heat applied to the exterior of the body, for example, by a heating element of a shisha device, to the gel 310 and the aerosol-forming substrate 300 in the cavity 218.

Figure 3A:
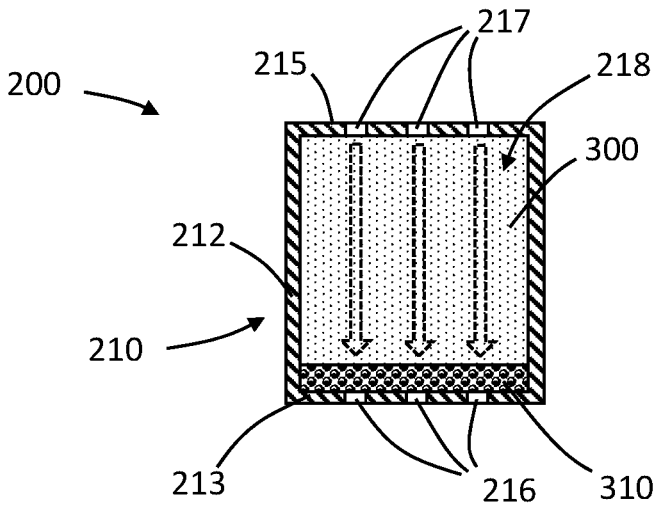
FIGS. 3A and 3B are schematic sectional views of a cartridge with aerosol-forming substrate and gel.
Figure 3B:
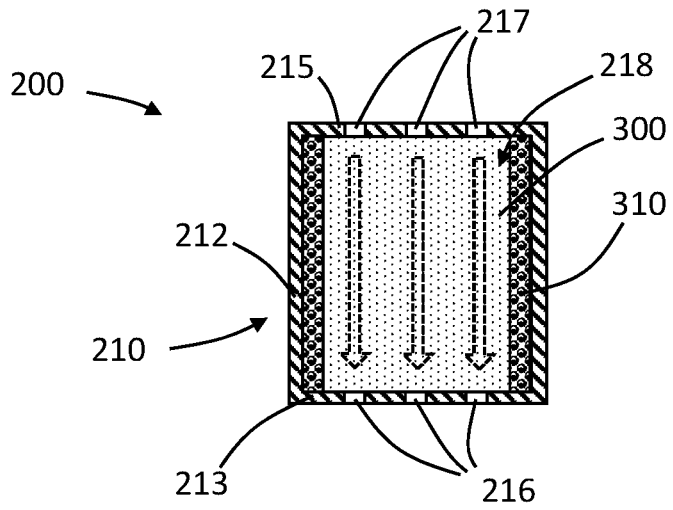

FIGS. 3A and 3B show the cartridge 200 having apertures 217, 216 extending through the top 215 and bottom 213 of the body 210. During the preheating of the electric shisha device, the gel within the cartridge is heated. The gel loses its gel state, unsealing the holes and opening air flow paths through the cartridge as indicated by the arrows in FIGS. 3A and 3B.

Figure 4A:
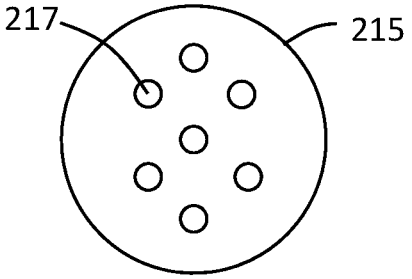
FIGS. 4A and 4B are schematic bottom and top views of a cartridge.
Figure 4B:
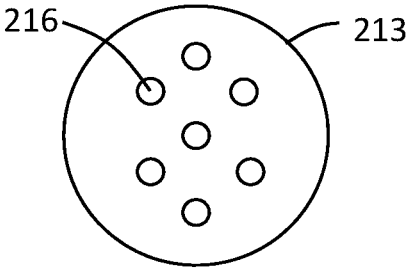

Referring now to FIGS. 4A and 4B, the top 215 and bottom 213 of the body may have a plurality of apertures 217, 216 to allow air flow through the cartridge, when the cartridge is in use. The apertures 216, 217 of the top 215 and bottom 213 may be aligned. The cartridge 200 may also or alternatively include apertures along the sidewall 212. The gel 310 may be disposed along the bottom 213, the top 215, and/or the side wall 212, covering some or all of the apertures. The apertures 217, 216 may further be blocked by a peelable seal or liner when the cartridge is stored prior to use.

Figure 5:
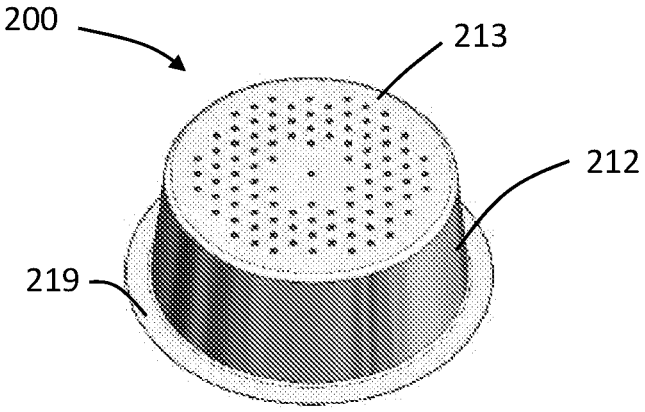
FIG. 5 is schematic perspective view of a cartridge.

FIG. 5 is a schematic perspective view of an exemplary cartridge 200. The sidewall 212 defines a frustroconical shape. The bottom 213 defines a plurality of apertures. The top comprises a flange 219 that extends from the sidewall 212. The flange 219 may rest on shoulder of a receptacle of a shisha device so that cartridge 300 may be readily removed from the receptacle after use by grasping the flange.

The specific embodiments described above are intended to illustrate the invention. However, other embodiments may be made without departing from the scope of the invention as defined in the claims, and it is to be understood that the specific embodiments described above are not intended to be limiting.

As used herein, the singular forms "a," "an," and "the" encompass embodiments having plural referents, unless the content clearly dictates otherwise.

As used herein, "or" is generally employed in its sense including "and/or" unless the content clearly dictates otherwise. The term "and/or" means one or all the listed elements or a combination of any two or more of the listed elements.

As used herein, "have," "having," "include," "including," "comprise," "comprising" or the like are used in their open-ended sense, and generally mean "including, but not limited to". It will be understood that "consisting essentially of," "consisting of," and the like are subsumed in "comprising," and the like.

The words "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the disclosure, including the claims.

Any direction referred to herein, such as "top," "bottom," "left," "right," "upper," "lower," and other directions or orientations are described herein for clarity and brevity are not intended to be limiting of an actual device or system. Devices and systems described herein may be used in a number of directions and orientations.

EXAMPLES

Example 1

The effect of the gel on aerosol formation was evaluated. A layer of gel was disposed at the bottom of a cartridge, and the cartridge was filled with 10 g of commercially available molasses (Al-Fakher). The gel layer had a thickness of 1 mm and covered an area of about 5 $cm^2$. The gel was prepared with 30 wt-% water, 1 wt-% agar (gelling agent), and 69 wt-% of vegetable glycerine (aerosol-former). A control sample was prepared without the gel layer.

The cartridge was inserted into a testing shisha device, where the cartridge was heated using a wire wound heater element with a set point temperature of 200° C. The set point temperature of the heater is selected to bring the molasses (between puffs) to a similar temperature as a charcoal operated shisha.

In order to improve the aerosolization process, a nozzle made of high temperature epoxy resin with an exit orifice of about 3 mm in diameter is placed at about 55 mm from the heating engine. A cooling jacket of dry ice surrounds the nozzle.

The generated aerosol is collected using a total of five Cambridge pads, and the weight of the pads is recorded before and after testing. At any given moment, only one of the pads collects the generated aerosol.

The total duration of the smoking test corresponds to 105 puffs. In order to achieve the desired puffing experience, programmable dual syringe pumps (PDSP, available from Pomac B.V. in Tolbers, Netherlands) were used simultaneously to create the puffing regime. The puffing regime was as follows: the sample and the control are tested for 105 puffs. The number of puffs is divided into five consecutive parts of 21 puffs each, where the aerosol from each part is collected in a separate Cambridge pad. After every 21 puffs, a valve ensures that the aerosol is diverted to the correct Cambridge pad. As a consequence, the production of aerosol can be monitored as a function of time.

Figure 6:
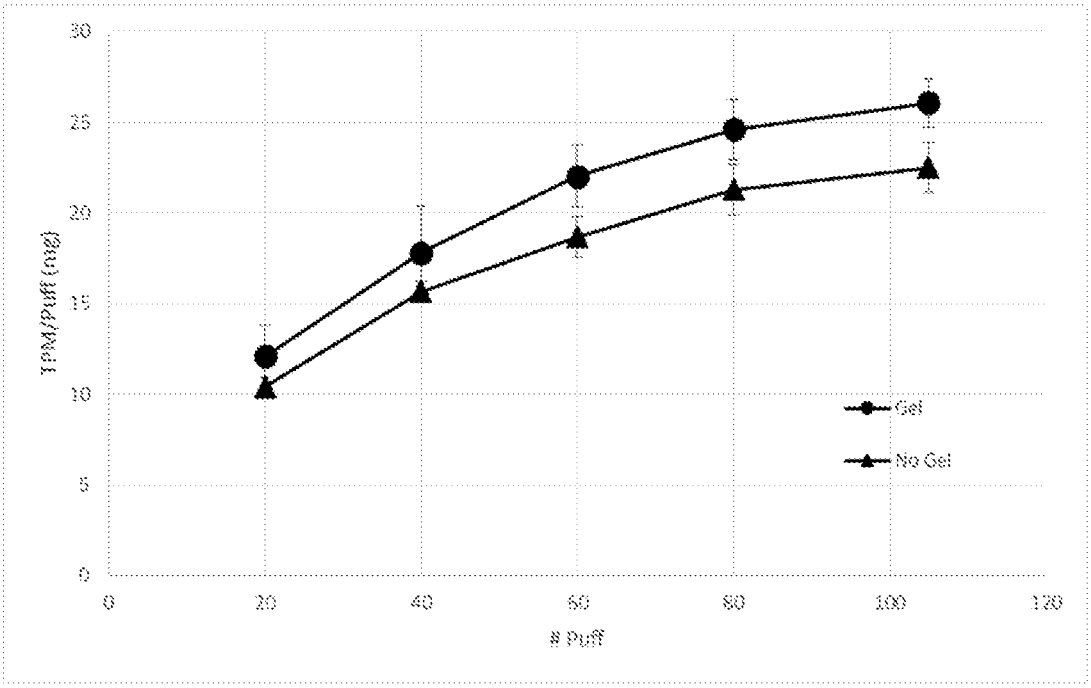
FIG. 6 is a graphical representation of test data from Example 1.

The results of total aerosol mass (TAM) collected over the first 21 puffs, and the total 105 puffs for the control and the sample are shown in TABLE 1 below and in FIG. 6. The results for the first 21 puffs are calculated as mg/per puff, and the results for the total duration of the test (105 puffs) are given as an accumulated total mass in mg.

TABLE 1

TAM Results.

| | Control (no gel) | Sample (with gel) |
|---|---|---|
| TAM (mg/puff), first 21 puffs | 10.4 ± 0.6 mg/puff | 12.1 ± 1.7 mg/puff |
| TAM (mg), 105 puffs | 1858 ± 90 mg | 2155 ± 143 mg |

It was observed that a significant increase in aerosol generation was achieved during the first 21 puffs as well as throughout the experiment by the use of the gel. The total accumulated TAM during the test was also greater with the gel.

Thus, cartridges for shisha devices are described. Various modifications and variations of the invention will be apparent to those skilled in the art without departing from the scope and spirit of the invention. Although the invention has been described in connection with specific preferred embodiments, it should be understood that the invention as claimed should not be unduly limited to such specific embodiments. Indeed, various modifications of the described modes for carrying out the invention which are apparent to those skilled in the mechanical arts, chemical arts, and aerosol generating article manufacturing or related fields are intended to be within the scope of the following claims.

The invention claimed is:

1. A shisha cartridge comprising:

a body defining a cavity and an internal cavity surface;

an aerosol-forming substrate disposed in the cavity; and a layer of gel, wherein the aerosol-forming substrate and the layer of gel are separate, distinct components;

wherein the layer of gel is disposed in the cavity adjacent the internal cavity surface and adjacent the aerosol-forming substrate.

2. The shisha cartridge according to claim 1, wherein the gel comprises an aerosol former.

3. The shisha cartridge according to claim 2, wherein the aerosol former comprises glycerine, propylene glycol, or a combination thereof.

4. The shisha cartridge according to claim 1, wherein the gel comprises from 10 wt-% to 80 wt-% of an aerosol former.

5. The shisha cartridge according to claim 1, wherein the gel comprises from 0.2 wt-% to 10 wt-% of a gelling agent.

6. The shisha cartridge according to claim 1, wherein the gel is arranged to retain its gel morphology up to a temperature of at least 50° C.

7. The shisha cartridge according to claim 1, wherein the gel is formulated such that when the gel reaches a temperature at which it loses its gel morphology, at least some of the compounds of the gel vaporize to form an aerosol.

8. The shisha cartridge according to claim 1, wherein the gel comprises a gelling agent comprising agar, carrageenan, or a combination thereof.

9. The shisha cartridge according to claim 1, wherein the gel comprises up to 75 wt-% of water.

10. The shisha cartridge according to claim 1, wherein the gel is disposed along an internal side wall of the cavity, a bottom of the cavity, a top of the cavity, or a combination thereof.

11. The shisha cartridge according to claim 1, wherein the internal cavity surface adjacent to which the gel is disposed comprises at least one aperture.

12. The shisha cartridge according to claim 11, wherein the gel is disposed adjacent the bottom of the cavity, and the at least one aperture is in the bottom of the cavity.

13. The shisha cartridge according to claim 1, wherein the gel has a surface area of 1 $cm^2$ to 25 $cm^2$.

14. The shisha cartridge according to claim 1, wherein the gel has a thickness of 0.1 mm to 10 mm.

15. The shisha cartridge according to claim 1 wherein the layer of gel lines at least a part of the cavity.

16. The shisha cartridge according to claim 1, wherein the aerosol-forming substrate is a shisha substrate.

17. The shisha cartridge according to claim 1, wherein the aerosol-forming substrate comprises tobacco.

18. The shisha cartridge according to claim 1, wherein the aerosol-forming substrate comprises tobacco and molasses.

19. The shisha cartridge according to claim 1, wherein the aerosol-forming substrate has a first time to first puff and the gel has a second time to first puff, wherein the second time to first puff is shorter than the first time to first puff.

20. The shisha cartridge according to claim 1, wherein the layer of gel is disposed between the internal cavity surface and the aerosol-forming substrate.

21. A shisha system comprising:

the shisha cartridge according to claim 1; and a shisha device comprising:

a receptacle for receiving the cartridge;

a heating element for heating the aerosol-generating substrate when the cartridge is received in the receptacle of the shisha device;

a vessel having a liquid fill level and defining a head space above the liquid fill level;

an aerosol conduit for conveying aerosol from the receptacle to below the liquid fill level in the vessel; and an outlet in communication with the head space.

* * * * *